United States Patent [19]

Ogino

[11] Patent Number: 4,550,970

[45] Date of Patent: Nov. 5, 1985

[54] ELECTRIC TERMINAL

[75] Inventor: Satoru Ogino, Kitamoto, Japan

[73] Assignee: Kobishi Electric Co., Ltd., Japan

[21] Appl. No.: 529,950

[22] Filed: Sep. 7, 1983

[51] Int. Cl.[4] ..... H01R 4/02

[52] U.S. Cl. ..... 339/97 P; 339/272 R; 339/147 R; 339/272 A

[58] Field of Search ..... 339/272, 263, 97 R, 339/97 P, 99 R, DIG. 2

[56] References Cited

U.S. PATENT DOCUMENTS

| | | | |
|---|---|---|---|
| 2,551,636 | 5/1951 | Ratigan | 339/272 UC |
| 2,997,683 | 8/1961 | Koenig | 339/99 R |
| 3,072,881 | 1/1963 | Norris | 339/272 UC |
| 3,163,482 | 12/1964 | Hubbell et al. | 339/97 P |
| 4,077,691 | 3/1978 | Hagermo | 339/263 R |
| 4,145,107 | 3/1979 | DeHaitre | 339/263 R |

FOREIGN PATENT DOCUMENTS

| | | | |
|---|---|---|---|
| 249144 | 9/1966 | Austria | 339/272 R |
| 402102 | 5/1966 | Fed. Rep. of Germany | 339/263 R |

*Primary Examiner*—Gil Weidenfeld
*Assistant Examiner*—David L. Pirlot
*Attorney, Agent, or Firm*—Darby & Darby

[57] ABSTRACT

An electric terminal for electrically connecting a conductor. The electric terminal includes: a casing; a stationary member made of an electrically conductive material and attached to the casing, the stationary member having a recess formed therein; a movable member; and a screw member threadedly engaging with the movable member and rotatably supported by the casing so that the movable member moves towards and away from the stationary member by the rotation of screw member, whereby one end portion of the conductor is clamped between the stationary member and the movable member by fitting at least part of the movable member into the recess of the stationary member.

14 Claims, 13 Drawing Figures

ELECTRIC TERMINAL

BACKGROUND OF THE INVENTION

The present invention relates to an electric terminal and is applicable particularly, but not exclusively, to reed switches and the like.

In FIGS. 1 and 2, there is illustrated a typical example of the conventional reed switch device which generally includes a reed switch 3 having its leads fixed to a pair of terminal plates 1 and 1 by machine screws or soldering, a pair of terminal screws 9 and 9 threadedly engaging with respective terminal plates 1 and 1 for securing stripped end portions or lead portions of two insulated conductors 7 and 7 with washers 5, and a casing 10, made of an electrically insulating material such as a synthetic resin, glass, etc., for covering the above-mentioned members. In many cases, the threaded shank of terminal screw 9 is inserted into casing 10 from the outside, and the head thereof and the connection portion thereof with respect to conductor 7 are, as shown in FIG. 2, exposed to the outside. In connecting conductor 7, the shank of terminal screw 9 is inserted into a lead portion to be connected to that conductor 7, which lead portion is curled like a ring as shown in FIG. 1, and is then rotated to secure that lead portion. However, if the curled lead portion of conductor 7 is secured by screw 9 with the curling direction of that lead portion being set in the loosening direction of screw 9, the original shape of the lead portion is deformed by the friction with washers 5 and 5 when screw 9 is tightened, so that the securing of the conductor end becomes less positive. This is because the frictional force generated on the deformed lead portion of the conductor becomes smaller due to a smaller stress produced in it by the tightening of terminal screw 9, and because when the lead portion of conductor 7 consists of twisted wires, the wires are untwisted by the rotation of screw 9. It is therefore laborious and time consuming to positively connect the conductor 7.

In order to remove such drawbacks there has been adopted a method in which a terminal lug having an eye is soldered to the lead portion of a conductor, and is then fastened to an electric terminal by inserting terminal screw 9 into the eye thereof and by tightening that screw. However it is also time consuming to solder the terminal lug to the conductor. Alternatively, washer 5 may be provided at its face with a substantially ring-shaped recess, into which the lead portion of a conductor is fitted for the securing thereof. This washer however places limits on the available diameter of the conductor. Furthermore, the connected portions of conductors 7 are exposed to the outside and therefore insulating means are required for insulatedly covering such connection portions when high voltage is applied to the electric terminals. From these reasons there exists a strong need for an electrical terminal which fastens a conductor more easily and positively in a more safe manner.

SUMMARY OF THE INVENTION

Accordingly, it is an object of the present invention to provide an electric terminal which fastens a conductor more easily and positively than the prior art electic terminals.

It is another object of the present invention to provide an electric terminal which does not expose the portion, connected to the terminal, of a conductor to the outside whereby safety is enhanced when high voltage is applied to the terminal.

With the above and other objects in view, the present invention provides an electric terminal for electrically connecting a conductor, comprising: a casing; a stationary member made of an electrically conductive material and attached to the casing, the stationary member having a recess formed therein; a movable member; and a screw member threadedly engaging with the movable member and rotatably supported by the casing so that the movable member moves towards and away from the stationary member by the rotation of screw member; whereby one end portion of the conductor is clamped between the stationary member and the movable member by fitting at least part of the movable member into the recess of the stationary member.

DETAILED DESCRIPTION OF THE PREFERRED EMBODIMENTS

Figure 1:
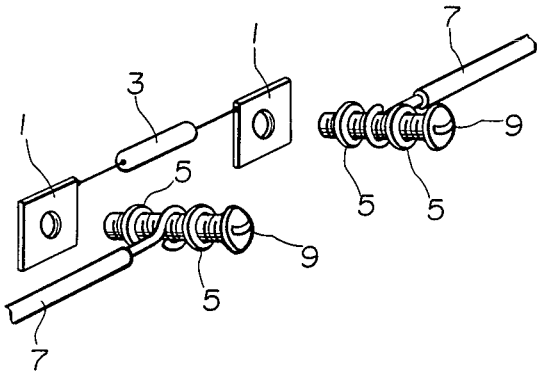
FIG. 1 (Prior Art)
FIG. 1 is an exploded view of the conventional reed switch device.
Figure 2:
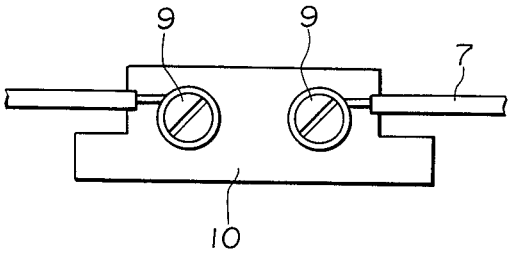
FIG. 2 (Prior Art)
FIG. 2 is a front view illustrating the assembled reed switch device in FIG. 1.
Figure 3:
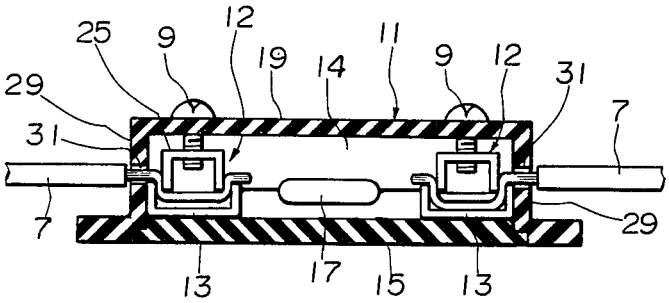
FIG. 3 is a longitudinal section of a reed switch device incorporating a pair of electric terminals according to the present invention with conductors being connected.
Figure 4:
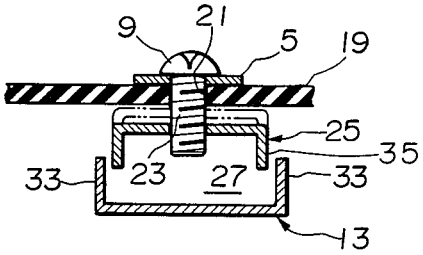
FIG. 4 is an enlarged vertical section of one of the electric terminal in FIG. 3 in which the conductor is not connected.

Referring now to the drawings, like reference characters designate like or corresponding parts throughout the several views. FIG. 3 illustrates a reed switch device incorporating a pair of electric terminals 12 and 12 according to the present invention, in which 13 designates a channel-shaped stationary member made of an electrically conductive material such as brass, the stationary member being fastened to a removable bottom plate 15 of a substantially box-shaped casing 11 by means of a screw or the like (not shown). A pair of terminal screws 9 and 9, which have each a washer 5 fitted around their shanks 23, are rotatably supported on a top portion of casing 11 by inserting as shown in FIG. 4 their shanks into respective holes 21 formed through that top portion. The washer 5 is not necessarily used. The shank 23 of each screw 9 threadedly engages with a web of a movable member 25 of a channel shape so that movable member 25 is opposed to stationary member 13. Then, bottom plate 15 having a pair of stationary members 13 fixed to it is attached as shown in FIG. 3 to the casing 11 by means of machine screws not shown. The movable member 25 is moved towards and away from stationary member 13 by rotating terminal screw 9 with a screw driver, and is thereby received in a recess or channel 27 defined by the flanges 33 of stationary member 13. The shank 23 of terminal screw 9 is long enough to prevent movable member 25 from disengaging from screw 9. Alternatively, the thread of the end of the shank 23 may be stripped for this purpose. In order to prevent movable member 25 from rotating about shank 23 of screw 9 during the vertical displacement thereof, the opposite ends of movable member 25 slidably contacts the corresponding opposite side walls 14 of casing 11.

Figure 5:
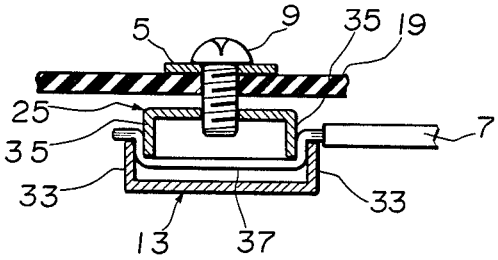
FIG. 5 is a view showing the electric terminal in FIG. 4 in which one of the conductors is connected.
Figure 6:
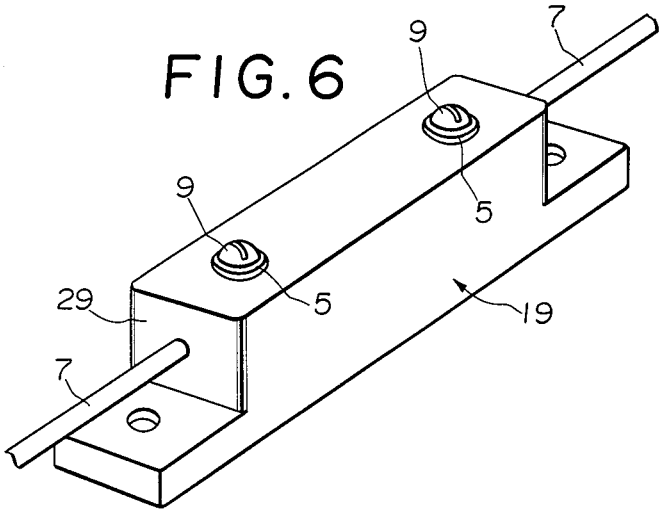
FIG. 6 is a perspective view illustrating the reed switch device in FIG. 3.

In the connection of two insulated conductors 7 and 7 to the electrical terminals 12 and 12, each movable member 25 is raised by rotating terminal screw 9 to a position shown by a phantom line in FIG. 4 where a vertical clearance is formed between the upper ends of flanges 33 and 33 of stationary member 13 and the lower ends of flanges 35 and 35 of movable member 25 so that a stripped end portion 37 of conductor 7 may easily pass through the clearance. Then, the end portion 37 is passed through a conductor inlet 31 formed through each of end walls 29 and 29, and is further passed through the vertical clearance so as to place it on the upper ends of flanges 33 and 33 of stationary member 13. Thereafter, terminal screw 9 is rotated in the reverse direction to lower movable member 25, and the lead portion 37 of conductor 7 which is in parallel with the bottom of stationary member 13 is thereby depressed by the lower ends of flanges 35 and 35 towards that bottom, so that it is deformed into a shape substantially of ⊔ as shown in FIG. 5. In this state, the lower outer edges of flanges 35 and 35 of movable member 25 and the upper inner edges of flanges 33 and 33 of stationary member bite into the thus deformed lead portion 37 of conductor 7, and the conductor 7 thereby generates at that lead portion stresses which withstand a tension exerted on the conductor. In addition a resilient force which tends to return the deformed lead 37 to its original shape is applied to the engaging edges of flanges 33, 33, 35, and 35. The connection of conductor 7 is thus made positive by the combination of the biting of the edges of flanges 33, 33, 35 and 35 into lead portion 37 of conductor 7 and the frictional force due to the restoring force of the deformed lead portion 37. In FIG. 6 there is illustrated the reed switch device to which conductors 7 and 7 are thus connected. In order to disconnect the conductors 7 movable members 25 are raised by rotating terminal screws 9 and 9.

Figure 7:
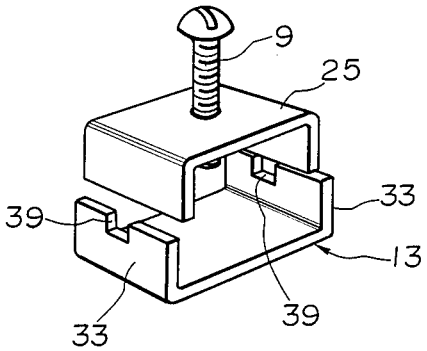
FIG. 7 is a perspective view illustrating a modification of the terminal in FIG. 4.

FIG. 7 illustrates a modified form of the electric terminal in FIGS. 3 to 5, in which the upper ends of flanges 33 and 33 are each provided with a square cutout 39, into which lead portion 37 of conductor 7 is inserted. The cutouts 39 more positively hold lead portion 37 of conductor 7. The cutout 39 may be of a semicircle or a V shape instead of rectangle. Further, the lower ends of both the flanges of movable member 25 may be corrugated for more positively holding the lead portion of conductor 7.

The movable member 25 may be made of any suitable electrically insulative material such as reinforced plastics, ceramics, etc. instead of brass, and it may be of a rectangular parallelepiped instead of the channel shape.

Figure 8:
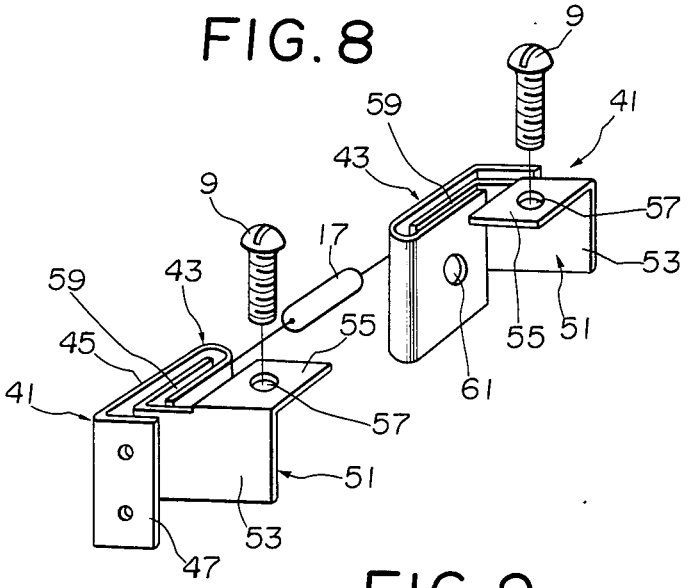
FIG. 8 is a perspective view showing another embodiment of the present invention.
Figure 9:
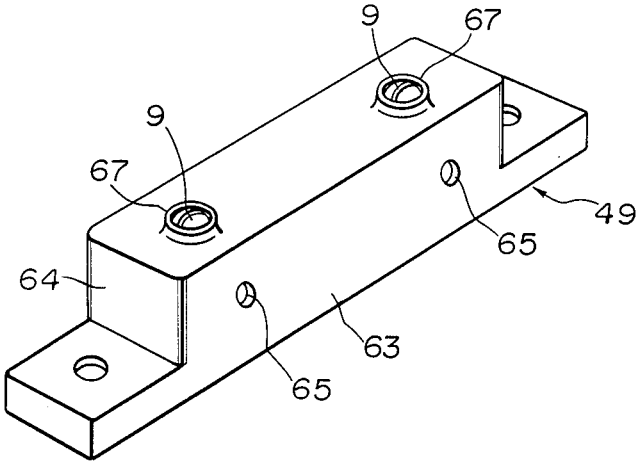
FIG. 9 is a perspective view illustrating another reed switch device incorporating the electrical terminals in FIG. 8.

Another embodiment of the present invention is shown in FIG. 8. This electrical terminal 41 includes a substantially channel-shaped stationary member 43 and a substantially L-shaped movable member 51. The stationary member 43 is provided with a longer flange 45 having a fastening strip 47 integrally formed with it at a right angle. The stationary member 43 is fastened to the inner face of each of end walls 64 of casing 49 (FIG. 9) by screwing fastening strip 47 to that inner face, with the channel of the member 43 being disposed in a vertical direction as in FIG. 8. On the other hand, movable member 51 is an angle plate, and has a lug 57 integrally formed with and projecting perpendicularly from the upper end of one leg 53 of movable member 51. Terminal screw 9 threadedly engages with a hole 57 formed through lug 55. The other leg 59 of movable member 51 is vertically moved by rotating the corresponding terminal screw 9 and is thereby moved vertically within the channel of stationary member 43. Both the flanges of stationary member 43 are provided at their central portions with concentric through holes 61 only one of which is shown in FIG. 8. The lead portions of two conductors 7 and 7 are inserted into conductor inlets 65 and 65 formed through one of side walls 63 of casing 49 shown in FIG. 9, and is then passed through the through holes 61 and 61 of the corresponding stationary member 43. Thereafter, movable member 51 is lowered by turning the corresponding terminal screw 9, so that the lead portion of the conductor 7 is deformed substantially into a ⊔ -shape as in the first embodiment by the lower end of leg 59, and it is thereby secured by the terminal 41. In this embodiment a pair of bosses 67 and 67 are integrally formed with the top surface of casing 49, and the shank of terminal screw 9 is rotatably passed through the bottom of each of bosses 67 and 67. The head of terminal screw 9 is received within boss 67. This structure reduces the exposed area of the head of terminal screw 9 and therefore increases safety in applying high votage to terminals 41 and 41.

Figure 10:
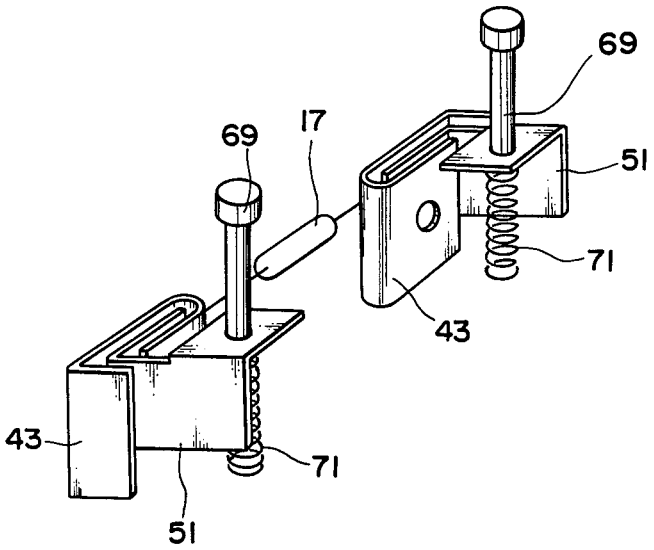
FIG. 10 is a perspective view illustrating a modification of the terminals in FIG. 8.

A modified form of the terminal 41 in FIG. 8 is shown in FIG. 10, in which a push button 69 is used in place of terminal screw 9. The shank of push button 69 is vertically attached to the upper face of lug 55, which is biased downwards by a coil spring 71. In the connection of conductor 7, button 69 is depressed and the lead portion of conductor 7 is thereby deformed and secured by the lower end of leg 59 of movable member 51 in the same manner as in the second embodiment.

Figure 11:
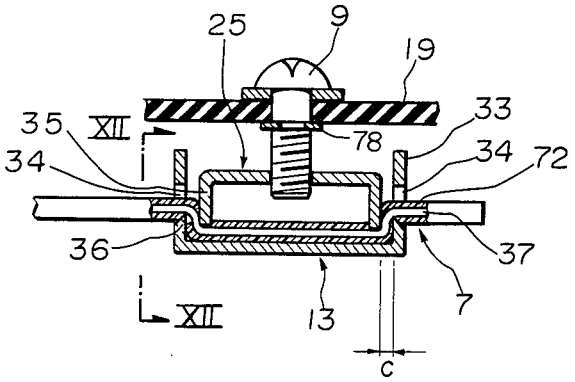
FIG. 11 is a vertical section showing a further modified form of the terminal in FIG. 4 with a conductor connected.
Figure 12:
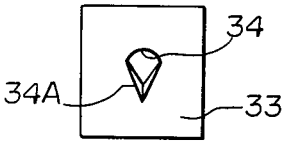
FIG. 12 is a view taken along the line XII—XII in FIG. 11 and showing the flange of the stationary member in FIG. 11.

In FIGS. 11 and 12, there is illustrated another modification of the electric terminal shown in FIGS. 4 and 5. In this modification the clearance C between the flange 33 of stationary member 13 and the cooperating flange 35 of movable member 25 is about the diameter of core conductor 37 of insulated conductor 7. The stationary member 13 is provided at its flanges 33 and 33 with through holes 34 and 34 opposed to each other. The hole 34 is substantially of a sector shape of which radii or V-shaped portion 34A converges downwards. The inner edges 36 of V-shaped portion 34A is formed to contain an acute angle or a right angle. In connection, an end portion of conductor 7 coated with an insulation coating 72, such as a synthetic resin, is passed through both holes 34 and 34, and terminal screw 9 is then rotated to depress movable member 25, with the result that only insulation coating 72 is severed by inner edges 36 of holes 34, so that the inner edges 36 come into electrical contact with core conductor 37. Thus, conductor 7 is electrically connected to stationary member 13. This modification makes it unnecessary to strip the coating 72 from the end portion of conductor 7, and hence largely facilitates the connection of insulated conductor 7. In FIG. 11, 78 indicates a C-shaped clip resiliently fitted into a circular groove formed around a base portion of the shank of terminal screw 9, and serves to prevent terminal screw 9 from vertically moving. Such clip is provided to each of terminal screws 9 in the preceding embodiments, but are not shown.

Figure 13:
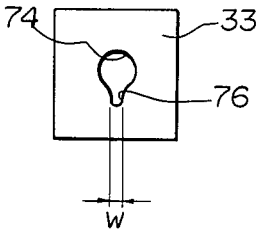
FIG. 13 illustrates a modified form of the flange of the stationary member in FIG. 12.

Instead of the sector hole 34, a hole 74 of a shape shown in FIG. 13 may be formed through flanges 33 and 33 of stationary member 13. The hole 74 is provided at the lower periphery thereof with a slot 76 extending downwards. The width W of slot 76 must be slightly smaller than the diameter of core conductor 37 in order to sever only the insulation coating 72 as in the modification in FIG. 11.

While the invention has been disclosed in specific detail for purposes of clarity and complete disclosure, the appended claims are intended to include within their meaning all modifications and changes that come within the true scope of the invention.

What is claimed is:

1. An electric terminal for electrically connecting a conductor, comprising:

(a) a non-conducting casing having a support surface;

(b) a stationary member made of an electrically conductive material and attached to the casing, the stationary member including a channel-shaped portion with a pair of flanges defining a recess therein which is open in the direction toward the support surface of the casing;

(c) an electrically conductive movable member having a portion adapted to be inserted into the recess of the stationary member; and (d) an electrically conductive screw member threadedly engaging with the movable member and making electrical contact with the conductive movable member without contacting the stationary member, said screw member being rotatably supported by the casing support surface so that the movable member moves towards and away from the recess in said stationary member by the rotation of said screw member, whereby one end portion of a conductor located between the stationary member and the movable member in the region of the recess is clamped between the stationary member and the movable member by the flanges of the stationary member and at least part of the movable member received by the recess of the stationary member.

2. An electric terminal as recited in claim 1, wherein the screw member includes a head and a threaded shank and wherein the threaded shank passes through the casing and the head is received within a second recess formed in an outer face of the casing.

3. An electric terminal as recited in claim 1, wherein the stationary member and the movable member are of channel shapes, each with a planar web between generally perpendicular flanges extending from an inner face, the movable member threadedly engages at its web with the screw member such that the inner face of the movable member is disposed toward the inner face of the stationary member, and the movable member is adapted to fit at least one of the flanges thereof into the recess.

4. An electric terminal as recited in claim 3, wherein the conductor is coated with an electric insulation coating; wherein at least one of cooperating edges of the flanges of the stationary member and the movable member is formed to contain an angle of 90° at maximum; and wherein the cooperating edges are horizontally spaced away so that the coating of the conductor is severed by the at least one edge when the conductor is clamped between the cooperating edges, whereby the conductor is brought into electrical contact with the at least one edge.

5. An electric terminal as recited in claim 3, wherein the stationary member is provided at its flanges with means for inserting the conductor therein.

6. An electric terminal as recited in claim 5, wherein the inserting means includes cutouts formed in the free end of each of the flanges of the stationary member.

7. An electric terminal as recited in claim 5, wherein the inserting means includes concentric holes formed through the flanges of the stationary member, the concentric holes having peripheral edges.

8. An electric terminal as recited in claim 7, wherein one end portion of an insulation coated conductor with a core which is placed to pass through the concentric holes of the stationary member becomes clamped by the peripheral edges defining each hole and a lower edge of the movable member by rotating the screw member so as to downwardly move the movable member, such downward movement causing the peripheral edges of the holes to cut the insulating coating so that electrical connection is established between the conductor and the stationary member.

9. The electric terminal as recited in claim 8, wherein the holes of the stationary member each have a circular shape.

10. The electric terminal as recited in claim 8, wherein the peripheral wall of each said hole of the stationary member is provided at its bottom portion with a slot extending downwards, the slot having a width slightly smaller than the diameter of the core conductor.

11. The electric terminal as recited in claim 8, wherein the horizontal clearance between the flanges of the stational member and the cooperating lower edges of the movable member is about the diameter of the core of the conductor.

12. The electric terminal as recited in claim 8, wherein the peripheral wall of each said hole has a V-shaped portion coverging downwards.

13. The electric terminal as recited in claim 12, wherein the inner edge of the V-shaped portion contains an angle not larger than a right angle.

14. A reed switch device comprising:

(a) a casing having a support surface;

(b) a pair of stationary members made of an electrically conductive material and each including a channel-shaped portion having a pair of flanges and an open side, each stationary member being formed with aligned through holes defined by peripheral walls of each stationary member, each stationary member being fastened to the casing so that the open side of the channel thereof is directed toward the support surface;

(c) a pair of electrically conductive movable members adapted to be inserted into the open side of the channel of a corresponding stationary member;

(d) a pair of electrically conductive screw members threadedly engaging with the corresponding movable members, respectively, and rotatably supported by the support surface of the casing so that each movable member moves into the open side of the channel of the respective stationary member by the rotation of the corresponding screw member; and (e) a reed switch connected between the stationary members, whereby one end portion of a conductor which is placed to pass through the aligned holes of one stationary member is clamped by the inner edge of the peripheral wall of each hole of the stationary member and lower edges of the movable member by rotating the respective screw member so as to downwardly move the movable member, so that an insulation coating of the one end portion is cut by the peripheral edges of the holes to thereby establish electrical connection between the conductor and the reed switch.

* * * * *